United States Patent [19]

Kondo

[11] 4,350,071

[45] Sep. 21, 1982

[54] AUTOMATIC ACCOMPANIMENT CIRCUIT

[75] Inventor: Nobuaki Kondo, Omiya, Japan

[73] Assignee: Kabushiki Kaisha Kawai Gakki Seisakusho, Japan

[21] Appl. No.: 250,851

[22] Filed: Apr. 3, 1981

[30] Foreign Application Priority Data

Apr. 19, 1980 [JP] Japan ..... 55/51988

[51] Int. Cl.[3] ..... G10H 1/40

[52] U.S. Cl. ..... 84/1.03; 84/DIG. 12

[58] Field of Search ..... 84/1.03, DIG. 12

[56] References Cited

U.S. PATENT DOCUMENTS

| | | | |
|---|---|---|---|
| 3,986,424 | 10/1976 | Sakashita | 84/1.03 |
| 4,089,245 | 5/1978 | Dietrich | 84/1.03 |
| 4,138,918 | 2/1979 | Kato | 84/1.03 |
| 4,149,441 | 4/1979 | Bergman et al. | 84/1.03 |
| 4,162,644 | 7/1979 | Sakashita | 84/1.03 |
| 4,163,407 | 8/1979 | Solender | 84/1.03 |
| 4,208,938 | 6/1980 | Kondo | 84/1.03 |
| 4,256,005 | 3/1981 | Mishima | 84/1.03 |

*Primary Examiner*—S. J. Witkowski

*Attorney, Agent, or Firm*—McGlew and Tuttle

[57] ABSTRACT

An automatic accompaniment circuit which is provided with a code detector for scanning key switches to detect the code of a depressed one of the key switches, a latch circuit for latching the output signal of the code detector by a bar clock pulse which is produced for each bar, a comparator for comparing the output signals of the code detector and the latch circuit to yield a coincidence signal, and control means for counting the coincidence signal from the comparator by a desired number of bars using the bar clock pulses and then providing a command signal for changing the pattern of an automatic accompaniment.

2 Claims, 3 Drawing Figures

AUTOMATIC ACCOMPANIMENT CIRCUIT

BACKGROUND OF THE INVENTION

1. Field of the Invention

The present invention relates to an automatic accompaniment circuit which, if a player has continued to play the same chord by a predetermined number of bars, automatically produces a different code pattern to break the monotony of the performance.

2. Description of the Prior Art

With a conventional automatic accompaniment circuit, for example, an automatic base sound generator, if the same code key is depressed for a long time during performance, then the automatic base sound generator repeats to generate a base sound in the same base pattern, resulting in the performance becoming monotonous. This can be avoided by providing a variation switch to create a varied base pattern but since a player plays a melody and an accompaniment with both hands, it is difficult for him to depress the variation switch while playing. Further, in order to cause a natural change in the base pattern, it is necessary to depress the variation switch in synchronism with the start of a bar; therefore, such an operation is difficult for the player even if he is skilful.

SUMMARY OF THE INVENTION

It is an object of the present invention to provide an automatic accompaniment circuit which is designed so that if the same code has continued for a certain period of time, a variation pattern is produced without the necessity of depressing a variation switch.

Briefly stated, the automatic accompaniment circuit of the present invention comprises a code detector for scanning key switches to detect the code of a depressed one of the key switches, a latch circuit for latching the output signal of the code detector by a bar clock pulse which is produced for each bar, a comparator for comparing the output signals of the code detector and the latch circuit to yield a coincidence signal, and control means for counting the coincidence signal from the comparator by a desired number of bars using the bar clock pulses and then providing a command signal for changing the pattern of an automatic accompaniment.

BRIEF DESCRIPTION OF THE DRAWINGS

FIGS. 1(A) and 1(B)are waveform diagrams explanatory of bar clock pulses for use in the present invention.

DESCRIPTION OF THE PREFERRED EMBODIMENTS

Figures 1, 2:
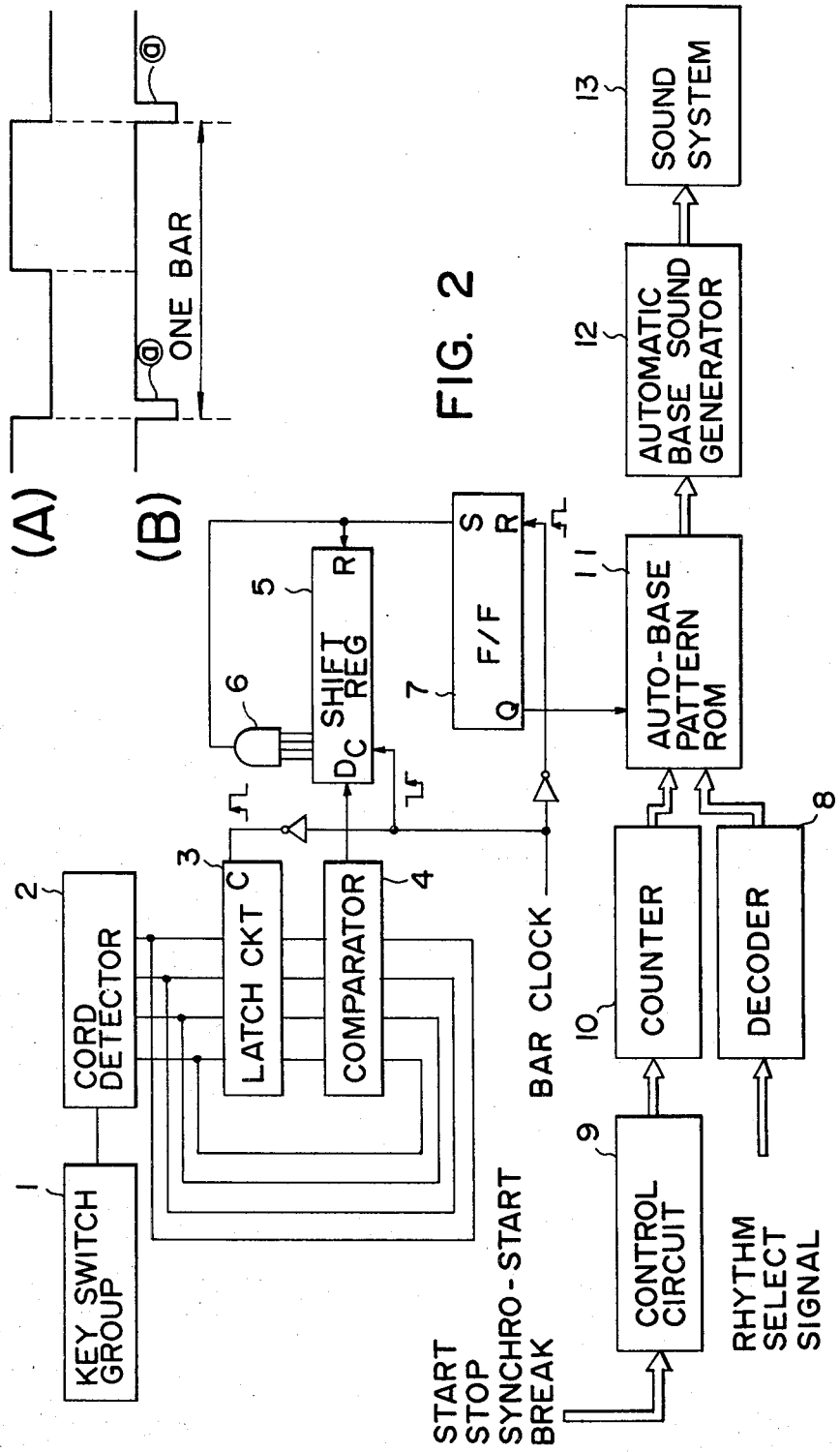
FIG. 2 is a block diagram illustrating an embodiment of the present invention.

In the present invention, bar clock pulses (a) shown in FIG. 1(B) are each produced in synchronism with the start of each bar depicted in FIG. 1(A). The number of bars of the same code is counted using the bar clock pulses and when the number of bars has reached a predetermined value, a code pattern is changed.

FIG. 2 is explanatory of an embodiment of the present invention.

In FIG. 2, a key switch group 1 is scanned and the code of a depressed key switch is detected by a code detector 2. The code thus detected by the code detector 2 is applied to a latch circuit 3, wherein it is latched at the rise of the bar clock which is provided via an inverter to the latch circuit 3. The output from the latch circuit 3 is supplied to a comparator 4, which compares the outputs from the latch circuit 3 and the code detector 2 and generates a coincidence signal. The coincidence signal is applied to a D terminal of a shift register 5, which is supplied at its C terminal with the bar clock pulse.

When the same key switch has been depressed for example, for four bars, the shift register 5 is shifted to provide a high-level output from an AND circuit 6 to set a flip-flop (F/F)7. The flip-flop 7 derives at its Q terminal a high-level command signal, by which the present base pattern read out from an autobase pattern ROM 11 is changed to a variation pattern. By the next bar clock pulse the flip-flop 7 is reset and the original base pattern is restored. In the above the base pattern is changed when the same key switch has been depressed over four bars, but the number of bars may be selected at will.

The reason for which the bar clock pulses are each set at the start of each bar is that it is necessary for the player to judge in one pulse duration whether or not the code be changed at the fourth bar. In contrast thereto, in the case where the base pattern is changed to a variation pattern at the start of a bar, the bar clock pulses are each set at the end of each bar.

When the code pattern thus read out from the autobase pattern ROM 11 has been varied, a base sound corresponding to the varied code pattern is produced by the arrangement of an ordinary automatic base sound generator. That is, a rhythm select signal selects a rhythm via a decoder 8 and start, stop, synchro-start and break control signals perform ON-OFF control of the auto base pattern ROM 11 via a control circuit 9 and a counter 10, by which the content of the auto base pattern ROM 11 is read out, and a base sound corresponding to the content read out from the ROM 11 is produced by an automatic base sound generator 12 and provided to a sound system 13. The automatic base sound generator comprises a tone generator and gate means therefor which is activated by the output from the ROM 11.

As has been described in the foregoing, according to the present invention, if the same key switch has been depressed over a predetermined number of bars, then it is detected and a command signal is generated to produce a variation pattern, thereby introducing a change in the base sound of the same code to break the monotony of performance. Since this is carried out automatically and in synchronism with the start of the bar, the base sound of this kind which is difficult to obtain by manual operation can easily be produced in a natural way.

It will be apparent than many modifications and variations may be effected without departing from the scope of the novel concepts of this invention.

What is claimed is:

1. An automatic accompaniment circuit comprising:

a code detector for scanning key switches to detect the code of a depressed one of the key switches;

a latch circuit for latching the output signal of the code detector by a bar clock pulse which is produced for each bar;

a comparator for comparing the output signals of the code detector and the latch circuit to yield a coincidence signal; and control means for counting the coincidence signal from the comparator by a desired number of bars using the bar clock pulses and then providing a command signal for changing the pattern of an automatic accompaniment.

2. An automatic accompaniment circuit according to claim 1 wherein the bar clock pulses are each generated in synchronism with the start of each bar.

* * * * *